US008216023B2

(12) United States Patent
Donnelly et al.

(10) Patent No.: US 8,216,023 B2
(45) Date of Patent: Jul. 10, 2012

(54) SUSPENSION-STYLED BRASSIERE PRIMARILY FOR MINIMIZATION OF INTRA-BREAST WRINKLING

(76) Inventors: Helene Donnelly, Manorville, NY (US); Eric Koenig, Huntington, NY (US); Mitchell A. Stein, Northport, NY (US)

( * ) Notice: Subject to any disclaimer, the term of this patent is extended or adjusted under 35 U.S.C. 154(b) by 1213 days.

(21) Appl. No.: 11/893,645

(22) Filed: Aug. 17, 2007

(65) Prior Publication Data

US 2009/0047868 A1 Feb. 19, 2009

(51) Int. Cl.
*A41C 3/00* (2006.01)

(52) U.S. Cl. ..... 450/89; 450/54; 450/57

(58) Field of Classification Search ..... 450/3–5, 450/8–11, 15–17, 20, 21, 25, 26, 28, 30, 450/31, 34, 65, 66, 75–79, 58, 89, 54–57, 450/36, 37, 38; 2/102, 463, 67, 73, 69, 104–106, 2/109, 110, 114, 113; 602/75, 41, 76, 19, 602/661, 53

See application file for complete search history.

(56) References Cited

U.S. PATENT DOCUMENTS

| | | | | | |
|---|---|---|---|---|---|
| 513,086 | A * | 1/1894 | Chambers | 450/58 |
| 1,082,085 | A * | 12/1913 | Keitel | 450/54 |
| 1,126,207 | A * | 1/1915 | Hayes | 450/15 |
| 1,267,657 | A * | 5/1918 | Grace | 450/18 |
| 1,868,391 | A * | 7/1932 | Kispert | 450/9 |
| 2,121,088 | A * | 6/1938 | La Rue | 450/36 |
| 2,180,390 | A * | 11/1939 | Blair | 450/18 |
| 2,392,724 | A * | 1/1946 | Cohen | 450/8 |
| 2,610,325 | A * | 9/1952 | Schlussel | 450/89 |
| 2,717,602 | A * | 9/1955 | Radler | 623/7 |
| 7,001,239 | B2 * | 2/2006 | Russell | 450/57 |
| 7,144,295 | B2 * | 12/2006 | Fisher | 450/54 |
| 7,445,541 | B2 * | 11/2008 | Patterson | 450/54 |

* cited by examiner

*Primary Examiner* — Gloria Hale

(74) *Attorney, Agent, or Firm* — Mitchell A. Stein, Esq.; Stein Law, P.C.

(57) ABSTRACT

A brassiere for minimizing the effects of wrinkling having two cups for the wearer's breasts and a central space therebetween, having a pouch wovenly positioned in the central space, the pouch having a suspension-styled stitching assembly for articulating the cups and hence the women's breasts in a structural and weight supported manner such that when the wearer is in a supine position the breasts are disinclined to sag; an aperture for receiving one or more articles; and a rear aperture such that the rear aperture leaves skin in the décolletage open for contact with one or more articles. The articles are selected from the group consisting of wickable stuffing material, foam material, memory-styled foam material, medicant, transdermal patch, and squeezable tubular assembly.

10 Claims, 3 Drawing Sheets

SUSPENSION-STYLED BRASSIERE PRIMARILY FOR MINIMIZATION OF INTRA-BREAST WRINKLING

FIELD OF THE INVENTION

The present invention relates to brassieres for providing structural support to the wearer's body and breasts, and more particularly to a suspension-styled system embedded in a pouch either intrinsically designed within a brassiere or thereafter added, for support during supine positioning as in sleep to minimize wrinkling of the interstitial space between the breasts (as well as during upright and sports events), for the creation of a chamber for release of, among other things, anti-wrinkle medicaments. The invention more particularly relates to a suspension-styled system added to a brassiere primarily for effecting the muscular and skeletal structure of the woman and for the treatment of intra-breast wrinkling effects in the décolletage (the chest/cleavage area), and optionally involves the use of medicaments released transdermally or otherwise.

BACKGROUND OF THE INVENTION

A brassiere, commonly referred to as a bra, is an article of clothing that covers, supports, and elevates the breasts of a woman. The bra is considered a foundational garment, as well as an undergarment, because of its role in shaping the wearer's figure and its positioning below outer garments. Originally developed in the late nineteenth and early twentieth centuries, the intent of the bra was to replace the corset. It is now typical that a bra is worn to support and to restrain breasts both during normal functional, daily activity as well as during exercise (e.g., the sports bra).

Many women also wear bras under the belief that the wearing will prevent breasts from sagging during aging. In scientific and medical studies, however, there have been no conclusive studies that support the notion that wearing a bra of heretofore typical design will prevent sagging of breasts during aging. It is an object of the instant invention, however, to improve the support of breasts and associated skeletal musculature as well as to minimize or prevent the appearance of unsightly wrinkles intra-breast in the décollegate region (the chest/cleavage area).

Bras have been typically designed to lift the breasts. Breasts are basically cantilevered from the chest plate in normal position. Thus, the thought behind "lifting" of the breasts has been to create a more youthful look and/or for the enhancement of cleavage. These roles are sometimes conflicting. Indeed, to enhance support, cleavage is ordinarily reduced, while improving cleavage does not ordinarily provide support, leaving the wearer's body carrying the load. Designers have often wrestled with producing a garment that fulfills a practical role in support as well as a cosmetic role in rendering the wearer more attractive. It is an object of the instant invention to achieve such duality.

On the physiological and cosmetic side, it should be appreciated that wrinkles appear in the décolletage region (intra-breasts) not just as a consequence of aging or skin stretch (for a more robust breast), but also from sleeping positioning. Sleeping in the normal supine position, also typically involves sleeping on the side wherein one breast is gravitationally drawn to lie against the other, thereby increasing wrinkling intra-breast. Such potentially unsightly wrinkles, prevalent after such sleep, are of concern to women who wish their appearance to be attractive, not just to themselves but also to their mates.

Yet, structural-support bras to prevent or reduce the formation of wrinkles have heretofore been relegated to women who have undergone breast augmentation or in a less-than-suitable, awkward method for with women whose breasts naturally sag one over the other during sleep on the side. Due to the downward gravitational forces on the breast, the skin above the center and in the center of a woman's breast tends, by its very nature, to wrinkle. Structural-support undergarments for a women's upper chest have been traditionally designed to simply partition cleavage during sleep. It is another object of the instant invention to provide advancements not just in structural support to minimize wrinkling, but in the administering of medicaments, including transdermal patches filled with anti-aging/anti-wrinkling substrates like retinoic acid, and the like.

Tretinoin is the acid form of vitamin A and is also referred to as all-trans retinoic acid or ATRA, and also is referred to herein as retinoic acid. It is generally available as a cream or gel under the brand name "Retin-A" and is used for treatment of acne, and also has been shown to slow skin aging or remove wrinkles. The chemical equation is indicated below:

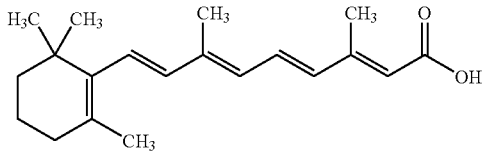

Likewise, a transdermal or skin patch is known to be an adhesive patch placed on the skin to deliver a time released dosage of medication. Typically, a transdermal comprises a liner, drug, adhesive, membrane and backing and has been used predominantly for nicotine and pain medication. In the instant invention, retinoic acid is released either through a transdermal patch or by way of a squeezable tubular assembly.

By way of additional background, anatomically, the breasts are non-rigid areas of glandular tissue, with few support structures, such as connective tissue. Breasts are composed of the mammary glands, which remain relatively constant throughout life, as well as the adipose tissue or fat tissue that surrounds the mammary glands. It is the amount and distribution of adipose tissue that leads to variations in breast size. In addition, the breasts contain internal ligaments, although their exact function as related to breast support is controversial. These ligaments, and the overlying skin (referred to as the dermal brassiere) help determine the resulting breast shape. As breasts mature, they fold over the lower attachment to the chest wall (infra-mammary fold), and their lower (inferior) surface lies against the chest wall when vertical. In popular culture, this maturation is referred to as "sagging" or "drooping," although plastic surgeons refer to it as ptosis, and recommend mastopexy (breast lift) for correction. However, it is the object of the instant invention to have engineered a bra design to counter these effects, designed to reduce or prevent the "sagging" effect and thereby reduce the production of wrinkles in a woman's upper chest.

In the instant invention, it should be appreciated that a bra is shown for many purposes, but the primary function is to support the women's physical structure and breasts, and to provide wearability during normal activities as well as physical activities. For example, in one embodiment, the suspension-styled design is shown to open the anterior muscles of the chest, correct the compression of the spine by assisting the body in upright support by posterior wrap-around suspension supports, relieve overstreched spasmodic mid and upper back muscles, and to reduce over-tightening of the pectoralis muscles. In the instant, preferred embodiment, the bra is worn while sleeping and is structured to decrease the formation of intra-breast wrinkles in the upper chest as well as to present a pouch location for the placement of other items, including a transdermal patch or squeezable tube for release of anti-wrinkle medicaments. Other objects are shown which include controlled release from a central memory-foam styled material as well.

In terms of that which has heretofore been known, when women sleep on their sides, the breast on the upper side tends to suspend toward the lower side breast, thereby inducing wrinkles to form in the skin in the center of the breasts (above the sternum) and above the center of the breasts in an "intra-breast" manner. Brassieres for supporting the breasts have traditionally been made to prevent wrinkling by insufficient insertion of separators. Moreover, medicaments are not shown in brassieres for deterring or reducing the production of wrinkles on the skin of the upper chest of women.

The present invention relates to sleeping brassieres and in particular to a bra worn while sleeping that is structured to reduce the formation of wrinkles in the upper chest of women who sleep on their sides, in which the bra design further has a center insert of a firm resilient material fit within a soft fabric bra.

U.S. Pat. No. 6,769,955 to Fisher provides a soft fabric anti-wrinkle bra for sleeping with a center breast support pad to be worn by a woman that is designed to keep an upper breast suspended while the woman sleeps on her side, to prevent the upper breast from "sagging" and thereby prevent the formation of wrinkles in the skin of upper chest of the woman. However, Fisher fails to provide a functional musculo-skeletal support structure, nor does it include the use of any anti-wrinkle medicament or transdermal adhesive patch to be affixed onto a padded cylindrical aperture between the breasts of a woman.

U.S. Pat. No. 7,144,295 to Fisher provides a breast support pad for supporting the upper breast when the wearer of a brassiere is lying on one side, the breast support pad is set inside and against the central portion of the brassiere between the two curved portions and away from the other portions of the brassiere. The breast support pad is comprised of a body having a front face with a thick vertical section and a back face adapted to conform with the chest of the wearer between the breasts. The back face is comprised of a concave cavity on each side of a centrally located vertical surface, each concave cavity adapted to conform to and support either breast when the wearer lies on one side. Yet, again, no consideration is given to Fisher to the actual design of the bra itself to supply support in synergy with an intra-breast support, nor is there even a hint of the use of any anti-wrinkle medicaments or a central, cylindrical aperture for the placement of other materials as needed.

U.S. Pat. No. 5,897,422 to McGee, provides a sleeping brassiere that has a pair of shoulder supports, which extend to a back support. The sleeping brassiere also has a back support that extends from the back toward the front of the wearer, a portion encircling the wearer and a pair of cup-shaped breast supports. Each breast support has a crescent-shaped portion that curved around the outside and top of the wearer's breast. The crescent-shaped portion has an upper end adjoining the shoulder supports and a lower end adjoining the back supports portion that encircles the wearer at a position between and below the center of the woman's breasts when worn. It is clear that McGee teaches away from the instant invention in designing a device that physically separates the breasts but provides nothing therebetween. Nor can it be said that such a design, which is of obviously different intent, could be combined with any other. It is a "one of a kind" and likely its absence of commercial success the best indicator of its dysfunction.

U.S. Pat. No. 5,083,555 to Lewis, provides an apparatus for reducing and preventing skin deformation near the breasts when worn therebetween, which includes a shaped deformable resilient support member that has both a first and second end. A removable outer casing that encompasses the shaped support member, has a first casing end adjacent the first support member end and a second casing end adjacent the second support member end. A first closure means is positioned at the first casing end and a second closure means is positioned at the second casing end, the closure means being adapted for enclosing the first and second support member ends within the outer casing. A securing means is on the outer casing between the first and second casing ends, the securing means being used for securing the bra to the torso of a human female and between the breasts of the female to reduce or prevent the appearance of skin wrinkling. This hyper-complex apparatus can only be uncomfortable and lacking in appearance, nor does it even suggest suspension-bridged stitching structures or a transdermal adhesive patch impregnated with medicaments located within a central resilient support pad.

U.S. Pat. No. 5,961,986 to Killen provides an anti-wrinkling apparatus that employs a substrate with an adhesive for securing the apparatus to the user's skin for the reduction or prevention of skin folding, and, thus, the appearance of wrinkles on the user's skin resulting from the wearing of the bra. The purpose is general wrinkle minimization as a result of the flattening effect of the bra against the woman's breasts. Killen also shows a substrate with a heart shape design. However, in contradistinction from Killen, the nature of the present invention is not to seek to minimize its effects on the wearer, but to minimize the stresses associated with the female breast while in motion as well as supine, and to provide musculo-skeletal support while also allowing the presentation of anti-wrinkle medicaments and other materials through a unique and functional structure U.S. Pat. No. 6,102,772 to Fernandez ostensibly shows an anti-wrinkle brassiere for night use and as a tool for preventing inter-mammary wrinkles. It also has a protection element for the back and the dorsal vertebra and it prevents back pain. It has a front portion that cover the inter-mammary zone and two oblique straps, which are joined to the extended back portion, that prevent the inner sides of the breasts from touching. The straps only cover the shoulder part and form lateral arches, which deviate from the line marked by the day brassiere, for good lymphatic drainage. It remains fastened to the skin and its inferior border is located slightly under those found on traditional bras. However, Fernandez fails to employ a suspension-style stitching and concomitant bra design to separate, isolate and support the breasts in supine positions (as well as during normal activity) to provide musculo-skeletal support and to prevent wrinkling of the wearer's skin in the upper chest during sleep. Moreover, the invention does not utilize a transdermal patch impregnated with anti-wrinkling medicaments—including, e.g., retinoic acid.

U.S. Pat. No. 5,807,160 to Wehmeyer provides a cleavage-wrinkle protector that is constructed of satin or similar lingerie-type fabric and stuffed with polyester fiberfill. The protector includes stretch lace neck and torso straps. The protector is approximately 6½ inches long and 2½ inches wide. The protector is engineered to be worn between the woman's breasts while sleeping to protect the cleavage skin from folding when the woman lies on her side. Limited consideration is given to the effects upon the skeletal or muscular system. In distinction, the instant invention utilizes a suspension-bridge styled support mechanism with an internal assembly for the presentation of a number of items, including transdermals, while supporting the shoulders and upper torso of the woman in a comfortable and elegant fashion.

U.S. Pat. No. 3,746,007 to Hand, provides a woman's sleeping garment that has the elements of a supportive brassiere. The garment simply molds and positions the breast even when the wearer is in an unusual sleeping position. However, Hand also fails to utilize suspension stitching to support and separate the breasts of a female wearer, and does not show the use of anti-wrinkle medicaments.

U.S. Pat. No. 1,891,871 to Donnet, provides a brassiere with a resilient, stiff and bent strip with rounded edges that is centrally located, which serves as a separating member between the breasts of a woman. This, too, shows little comparison to the instant invention.

The prior art observably demonstrates the long-felt need in the industry for a solution to a number of problems, namely a bra that provides support during sleep and a minimization of wrinkles, a sports-bra that can be utilized to deliver other items, like an endo-thermic reaction for cooling or a wicking material for absorption of sweat, nor, for that matter release of aromotherapeutic materials for relaxation and present odor.

This and other objects of the instant invention will best be understood by a comprehensive reading of the instant specification and claims, as well as a study of the drawings and the claims appended hereto.

SUMMARY OF THE INVENTION

In summary, a brassiere is shown for minimizing the effects of wrinkling in the décolletage of a wearer's body, the brassier having two cups for the wearer's breasts and a central space therebetween. In the central space is positioned a pouch assembly, wovenly positioned therein. The pouch assembly can be rectangular or cylindrical and can be either manufactured with the brassiere or added thereafter.

The pouch assembly critically comprises a suspension-styled stitching assembly for articulating the cups and hence the women's breasts in a structural and weight supported manner such that when the wearer is in a supine position the breasts are disinclined to sag. As shown in the preferred embodiment, the suspension-styled stitching is a cross hatch which provides the critical support and minimization of sagging as indicated and shown.

In the pouch assembly is an aperture for receiving one or more articles. Critically, again, there is a rear aperture that is an opening to the skin, thereby leaving the skin in the décolletage open for contact with one or more of the articles. Observably, the rear skin-opening aperture is also critical in that the articles in part must contact the skin for full efficacy of the device. In particular, certain of the articles are wickable. In other words, such articles absorb fluid, specifically sweat. Likewise, in order for anti-wrinkle creams and transdermals to be effective, there must be contact with the skin. Thus, the rear aperture provides the ability for such articles to contact the skin, as required. The articles are selected from the group consisting of a wickable stuffing material, foam material, memory-styled foam material, medicament, transdermal patch, and a squeezable tubular assembly.

The suspension-styled stitching assembly comprises either an inelastic material, an elastomeric material (like Lycra®) or combinations thereof. Depending upon the structure of the wearer and the location of the stitching, there is some necessity to balance elasticity with inelasticity in comformity with the suspension-bridge styling adapted to the instant invention.

The brassier also further comprises additional suspension-styled stitching in a plurality of different regions sufficient to assist the wearer's body in the opening of anterior muscles of the chest, minimizing spinal compression, relieving overstretching and/or spasmodic conditions of the mid and upper back muscles, and reductioin in overtightening of the pectoralis muscles. As can be seen in further detail in connection with the preferred embodiment, stitching is added optionally to the strapping assemblies, mid-section supports and posterior upper and lower regions to complete the suspension system.

It is thus an object of the present invention is to provide a bra for sleeping with a breast support pad housed in an aperture of the center of the bra, positioned between the breasts, which supports the breasts with the woman sleeping on her side to prevent the upper breast from folding over the lower together with a transdermal Retin A® release onto the skin of the wearer and thereby minimize wrinkles in the center of the upper chest.

Another object of the present invention is to provide a bra for sleeping that employs suspension-style stitching, at the midline of the brassiere, used to isolate, suspend and separate the breasts of a human female.

Yet another object of the present invention is to provide a bra for sleeping that provides a stitching system that eliminates and minimizes mobility in a manner that suspends the breast in a natural position as well as a number of dynamic positions.

Yet a still further object of the present invention is to provide a bra for sleeping that minimizes the effects of gravity on a sagging breast when the breast support pad, together with the suspension stitching, equally counters and resists the said compressive force of gravity on the breast regardless of dynamic position.

It is still yet a further object of the present invention is to provide a bra for sleeping that augments the frontal support of a human female's breasts.

It is still a further object of the present invention is to provide a bra for sleeping that utilizes a central pad housed within a cylindrical aperture together with transdermal adhesive patches impregnated with medicaments—including Retin A®.

Other and further objects and features of the instant invention are evident from a full and complete reading of the specification, drawings and claims appended hereto and the foregoing is not intended to minimize but rather to enhance the spirit, intent and scope of the instant invention.

BRIEF DESCRIPTION OF THE DRAWINGS

These and other details of the present invention will be described in connection with the accompanying drawings, which are finished only by way of illustration and not in limitation of the invention, and in which drawings.

DETAILED DESCRIPTION OF THE PREFERRED EMBODIMENT

Figure 1:
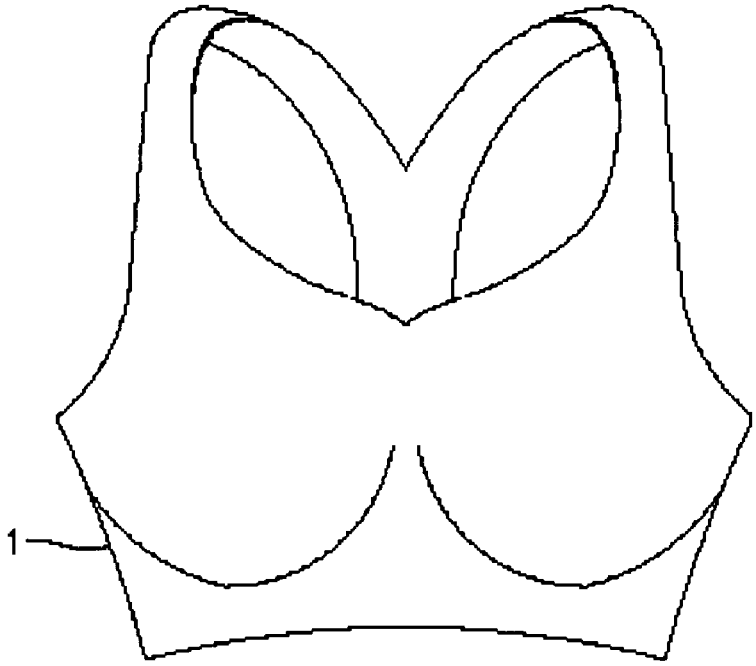
FIG. 1 is a perspective frontal view of a typical brassier.
Figure 2:
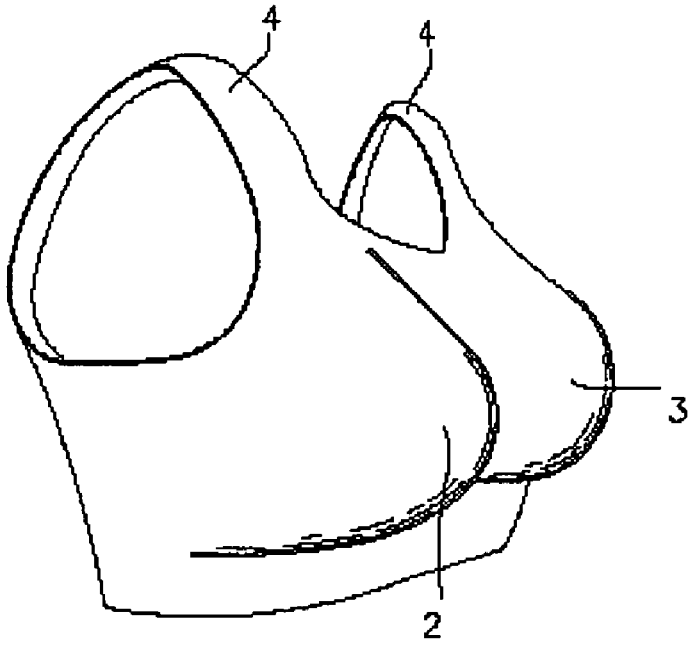
FIG. 2 is a perspective side view of one embodiment of a typical brassier.
Figure 3:
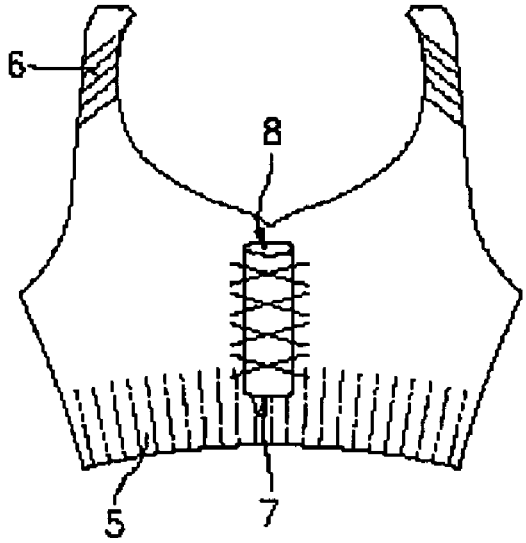
FIG. 3 is a an anterior view of the preferred embodiment of the present invention showing the pouch assembly and suspension-styled stitching.
Figure 4:
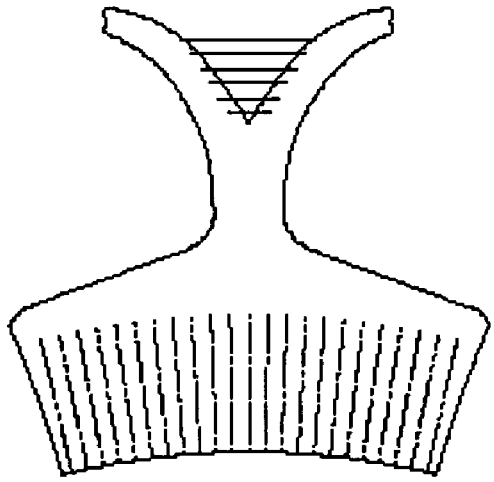
FIG. 4 is a posterior view of the preferred embodiment of the present invention showing the pouch assembly and suspension-styled stitching.

In FIG. 1, a bra 1 for sleeping supports an upper breast of a human female wearer sleeping on her side to counter the gravitational effects of a downward sagging breast onto a lower positioned breast of a female wearer thereby preventing wrinkles forming in the skin of the upper chest. The bra 1 comprises a breast support pad 7, in a cylindrical aperture 8, as shown in FIG. 3, positioned between the breasts of a woman, together with suspension stitching 5,6,9. The central support pad 7 comprises a firm body with a thick midsection 10, as shown in FIG. 4. The central support pad 7 further comprises a transdermal adhesive patch 14 impregnated with medicaments—including, e.g., Retin A®, which conform to the chest structure between the breasts of a woman 15. The support pad also has a concave curved cavity 13, shown in FIG. 5, on each side that supports either breast of the woman 11,12 with the breast in an upper position when the woman is sleeping on her side and prevents the upper positioned breast from hanging down and toward the lower breast, thereby minimizing wrinkling of the skin on the chest of the woman between the breasts. The insert transdermal patch 14 is in the insert pouch—or cylindrical aperture 8. The support pad 7 is formed of a molded firm body material, such as a molded dense foam material, to conform to the shape of the inner chest of a woman 15 for the adequate release of anti-wrinkling medicaments—including the Retin A®.

Figure 5:
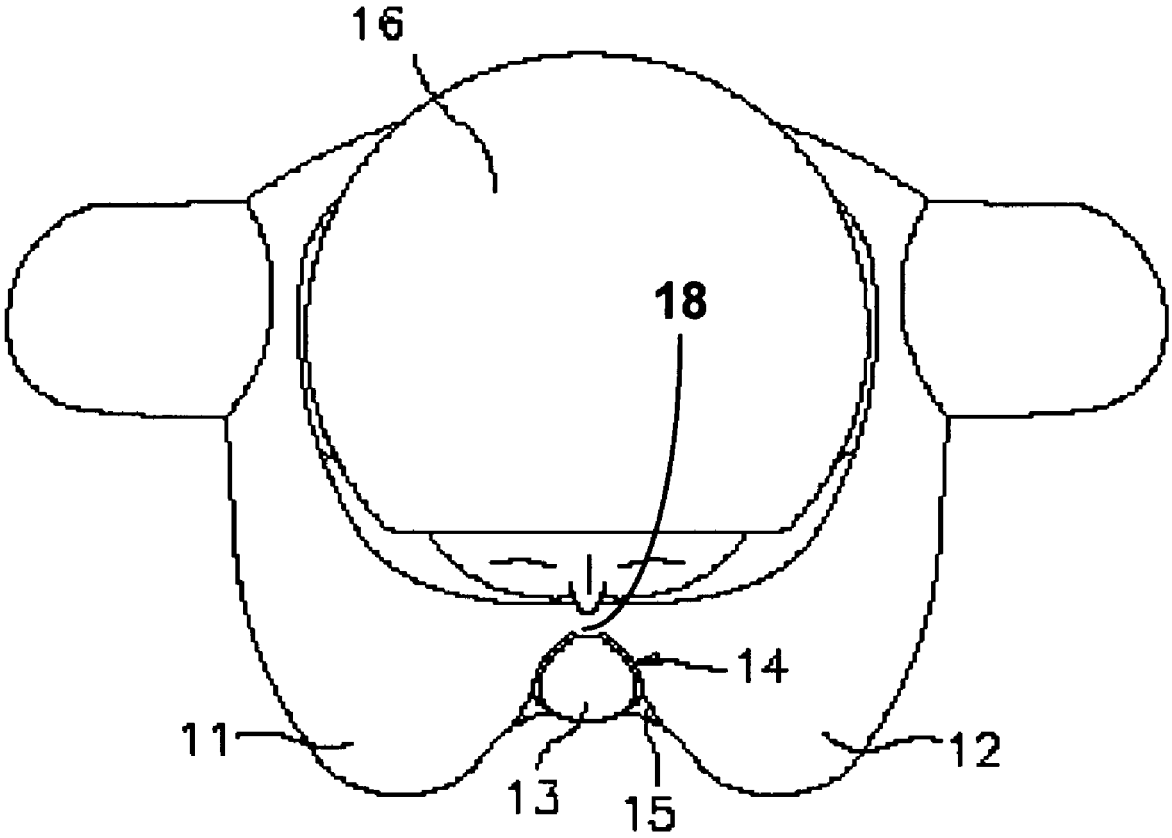
FIG. 5 is an aerial view of one embodiment of the anti-wrinkling brassiere displaying the inserted cylindrical aperture, which houses the central breast support member together with the transdermal adhesive patch with medicaments.

In FIGS. 3 & 4, the bra for sleeping 1 also comprises a soft fabric bra with a body encircling portion 5, and suspension stitching 9, with a pair of curved front portions 2,3 for supporting the breasts of a human female and a centrally located support member 7 between the curved front portions 2,3 for retaining the breast support pad 7 therebetween. The cylindrical aperture means 13, as shown in FIG. 5, comprises an insert pouch 15, which is formed together with a suspension support stitching 10 and an elastic piece of material to the bra between the curved front portions 11,12. The sheet of material is formed of soft fabric larger in size than the breast support pad 7, and is stitched using suspension style stitching 10 to the back of the bra, thereby forming an encapsulated barrier 15 between the breast support pad 7 and the skin of the woman shown visible at position 18.

It is understood that the preceding description is given merely by way of illustration and not in limitation of the invention and that various modifications may be made thereto without departing from the spirit of the invention as claimed. The description has not attempted to exhaustively enumerate all possible variations. That alternate embodiments may not have presented for a specific portion of the invention or that further undescribed alternate embodiments may be available for a portion is not to be considered a disclaimer of those alternate embodiments.

We claim:

1. A brassiere for minimizing the effects of wrinkling in the décolletage of a wearer's body, the brassiere having two cups for the wearer's breasts and a central space therebetween, comprising:

(a) a pouch assembly, wovenly positioned in the central space, said pouch assembly comprising:

(1) a cross-hatched suspension-styled stitching assembly for articulating the cups and hence the women's breasts in a structural and weight supported manner such that when the wearer is in a supine position the breasts are disinclined to sag;

(2) an aperture for receiving one or more articles; and (3) a rear aperture where the pouch assembly contacts the wearer's skin such that the rear aperture leaves skin in the decolletage open for contact with said one or more articles; and (b) wherein said one or more articles is selected from the group consisting of a wickable stuffing material, foam material, memory-styled foam material, medicament, transdermal patch, and a squeezable tubular assembly.

2. The brassiere of claim 1, wherein said pouch assembly is intrinsically woven into the brassiere with its manufacture.

3. The brassiere of claim 1, wherein said pouch assembly is added to a pre-manufactured brassiere.

4. The brassiere of claim 1, wherein said suspension-styled stitching assembly comprises an inelastic material.

5. The brassiere of claim 1, wherein said suspension-styled stitching assembly comprises a elastomeric material.

6. The brassiere of claim 1, wherein said suspension-styled stitching assembly comprises a combination of inelastic material and elastomeric material.

7. The brassiere of claim 1, wherein the brassiere includes strapping assemblies, mid-section supports and posterior upper and lower regions and further comprises additional cross-hatched suspension-styled stitching added to the strapping assemblies, mid-section supports and posterior upper and lower regions sufficient to assist the wearer's body in the opening of anterior muscles of the chest, minimizing spinal compression, relieving overstretching and/or spasmodic conditions of the mid and upper back muscles, and reduction in overtightening of the pectoralis muscles.

8. The brassiere of claim 1, wherein said medicament includes retinoic acid.

9. The brassiere of claim 1, wherein said transdermal patch includes retinoic acid.

10. The brassiere of claim 1, wherein said pouch assembly is cylindrical.

* * * * *